United States Patent [19]

Shockey

[11] 4,018,471

[45] Apr. 19, 1977

[54] ROTATING HEAD

[76] Inventor: Clyde J. Shockey, 761 North Ave. B, Kermit, Tex. 79745

[22] Filed: July 3, 1975

[21] Appl. No.: 593,024

[52] U.S. Cl. ..... 294/90; 24/249 DP; 24/263 D; 173/167; 294/102 A; 29/429

[51] Int. Cl.[2] ..... B66C 1/62

[58] Field of Search ..... 294/90, 91, 102, 113, 294/86 R, 86.1, 86.14, 86.33, 99 R, 117; 132/69; 29/429; 214/215; 24/263 D, 263 CA, 263 DQ, 249 LL, 249 DP; 173/167

[56] References Cited

UNITED STATES PATENTS

| | | | |
|---|---|---|---|
| 214,001 | 5/1879 | Hinderliter | 294/90 |
| 1,485,683 | 3/1924 | Lignoski | 294/102 A |
| 1,552,062 | 9/1925 | Krell | 24/249 DP |
| 2,122,513 | 7/1938 | Conner | 294/90 |
| 2,237,856 | 4/1941 | Wilson | 294/90 |
| 2,719,025 | 9/1955 | Stone | 173/167 |
| 3,149,391 | 9/1964 | Baster | 294/102 A |
| 3,309,130 | 3/1967 | Arrowood | 24/249 DP |
| 3,422,524 | 1/1969 | Timmons | 24/263 D |
| 3,458,230 | 7/1969 | Jones et al. | 294/90 |

*Primary Examiner*—James B. Marbert
*Attorney, Agent, or Firm*—Wendell Coffee

[57] ABSTRACT

A clamp is attached to a drill pipe beneath the rotating head when the pipe is pulled from the well. Not only does the clamp hold the rotating head in place, but, also, a ring-like handhold is provided on the clamp for handling the pipe with the drilling head thereon.

9 Claims, 4 Drawing Figures

ROTATING HEAD

CROSS-REFERENCE TO RELATED APPLICATIONS

None. However, by separate letter, a request is being made to transfer Disclosure Document No. 039588, filed March 20, 1975, to this application file.

BACKGROUND OF THE INVENTION

1. Field of the Invention

This invention relates to handling hand and hoist line implements; and more particularly to a grapple for use in oil well drilling.

2. Description of the Prior Art.

Often in drilling oil wells, gas under pressure is present at the bottom of the well. This gas pressure sometimes tends to cause a blowout. To prevent this, a rotating head is placed at the top of the well. The rotating head forms a seal between the stationary, permanent casing at the top of the well and the rotating drill pipe, which carries the bit on the bottom. The rotating head permits the drill pipe string to run down through it and maintain a seal to it. The seal to the rotating drill pipe rotates with the drill pipe, and the portion attached to the casing remains stationary. A typical rotating head weighs about 200 kg or more. Each time the drill string is pulled from the well, it is necessary to pull the rotating head from the casing and set it to one side on the drill rig floor. It is highly desirable not to permit the drill pipe to come out of the rotating head because it is difficult to insert the pipe through the rotating head again.

Therefore, according to common practice before this invention, a "cat" line or a short line is attached to the drilling head to hold it on fixed relationship to a section of drill pipe as it is pulled out of the well. Then, this section or stand of the drill pipe with the rotating head and cat line on it is set over to one side of the drilling rig floor. As soon as it is on the floor, some sort of device is attached to the drill pipe immediately below the rotating head. Prior to my invention, this device was in the form of pipe tongs, which were attached to the drill pipe immediately below the rotating head or, sometimes, a heavy rope was taken and wrapped around the drill pipe three or four times so it would form a friction hold on the drill pipe and, thus, maintaining the rotating head above the device.

The disadvantages of the prior art that if drill tongs are used, they project from the drill pipe, forming an obstruction on the drill rig floor. Also, obviously, often the pipe tongs are needed for some other function and are not available. If a rope is wrapped around a drill pipe, often the rope comes loose, sometimes causing a loss of fingers of the workmen. Also, those skilled in the art will understand that the drill pipe is greasy and covered with mud, making the equipment extremely difficult to handle.

SUMMARY OF THE INVENTION

1.New and Different Function

I have provided a clamp particularly adapted to clamp to the drill pipe below the drilling head to hold it in place more securely than before and, also, to provide on the clamp a ring-like handhold so the drill pipe with the rotating head thereon may be more easily moved from one point of the drilling rig floor to another.

In addition to this, when it is necessary to reassemble the drill pipe, the ring-like handhold may be used to rotate the pipe to attach it to the string of pipe already in the well.

2. Objects of the Invention

An object of this invention is to provide a clamp for holding a rotating head on drill pipe.

Other objects are to achieve the above with a clamp also having a ring-like handhold thereon to aid in handling equipment.

Further objects are to achieve the above with a device that is sturdy, compact, durable, lightweight, simple, safe, efficient, versatile, and reliable, yet inexpensive and easy to manufacture, install, adjust, operate and maintain.

Still further objects are to achieve the above with a method that is versatile, rapid, efficient, and inexpensive, and does not require skilled people to install, adjust, operate, and maintain.

The specific nature of the invention, as well as other objects, uses, and advantages thereof, will clearly appear from the following description and from the accompanying drawing, the different views of which are not necessarily to the same scale.

DESCRIPTION OF THE PREFERRED EMBODIMENT

Figure 1:
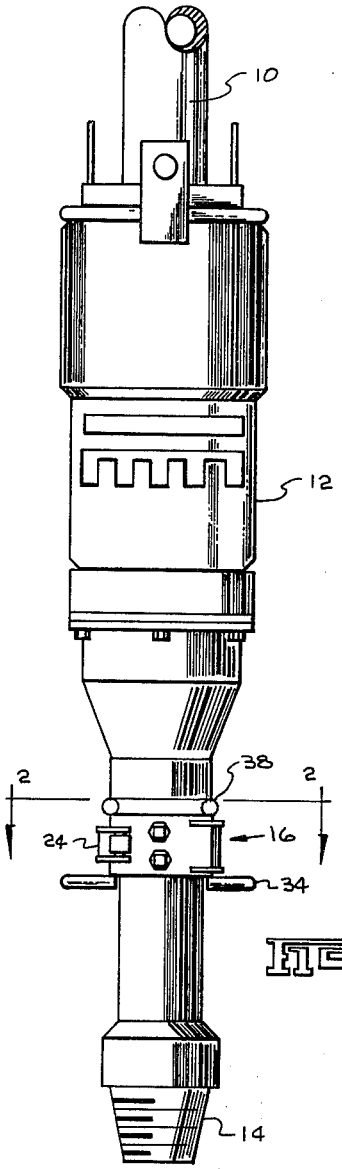
FIG. 1 is a side elevational view of an embodiment of the invention on a pipe holding the rotating head in place.

Referring to the drawing, and more particularly to FIG. 1, there may be seen drill pipe 10, sometimes called a drill stem. Upon the drill pipe is shown a representation of rotating head 12. It will be understood that as shown, the rotating head has been disconnected from the casing and hoisted to the drilling rig floor. Also, it will be seen that the drill pipe 10 has pin 14 on the lower end and it will be understood that it will have a box upon the other end.

Figure 2:
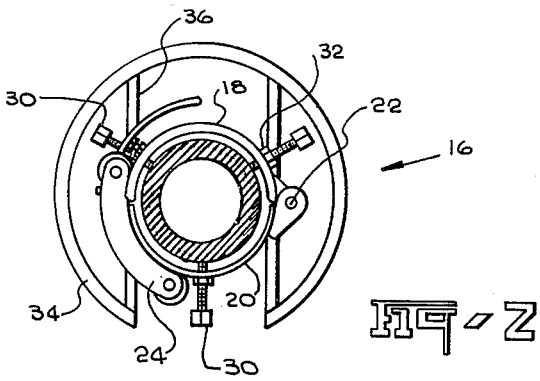
FIG. 2 is a sectional view taken substantially on line 2—2 of FIG. 1, showing the clamp on the pipe.

My clamp 16 is shown attached to the drill pipe in FIG. 1 and FIG. 2. The clamp itself will have collar segment 18 in the form of a semicylinder. Therfore, when in use and in place, it extends half-way around the pipe 10.

Gate 20 is also a semicylinder so that when the gate is closed, as seen in FIG. 2, the collar segment and gate form a complete cylinder or circle around the pipe. The gate is hinged to the collar segment by hinge 22 and the hinge bolt or hinge itself is parallel to the axis of the collar segment. Inasmuch as when in use the collar segment is coaxial with the pipe 10, the hinge will also be parallel to the axis of the pipe.

Latch 24 interconnects the gate 20 and the collar segment 18 when the gate is closed. The latch itself is an over-the-center type, sometimes described as a suitcase latch having moving latch portion 24 which cooperates with a keeper 26 on the collar segment 18. Actually, the latch bolt 28 moves against the keeper and is held in place by the main latch 24 to hold it in place. Any number of latches or fastening means could be used so that the gate is held securely and firmly closed.

Of course by firmly I mean in good tight fit to the pipe so it does not slide up or down when roughly handled.

The actual contact between the clamp and the pipe is by a plurality of set screws 30. As may be seen in the drawing, there are two courses of three set screws each. The set screws extend radially through the collar segment 18 and are held in position by lock nuts 32. There is one set screw in each course in the gate 20. Therefore, it may be seen that the set screws may be tightened and locked in place by the lock nuts 32 so that they hold the collar 16 securely and quite firmly in place. Therefore, it may be seen that with the set screws, not only may the clamp be tightened to the pipe, but, also, the set screws may be preset for different diameters of pipe.

Figure 3:
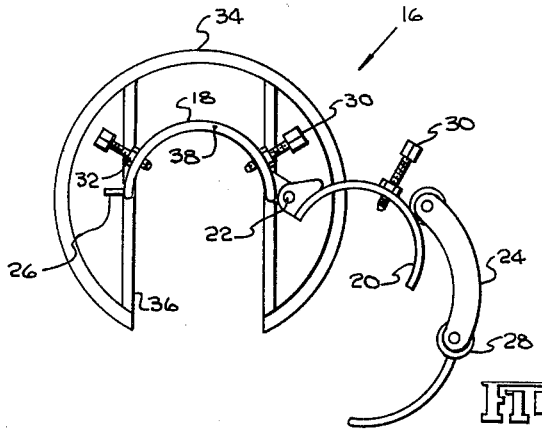
FIG. 3 is a top elevational view similar to FIG. 2 except showing the clamp open without the pipe.
Figure 4:
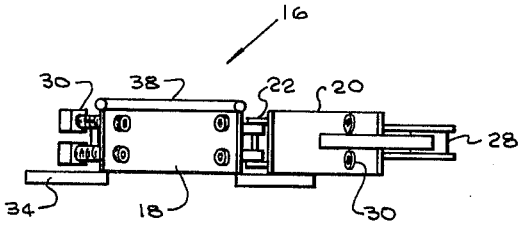
FIG. 4 is a side elevational view of the clamp.

Single arcuate handhold 34 forms a partial ring or C-ring around the pipe 10. The handhold is a segment of a circle and is concentric with the collar segment 18 and, therefore, when the clamp 16 is latched in place, the handhold will also be concentric with the drill pipe 10. The rod forming the perimeter of the handhold 34 has an opening in it, or a gap, which is at least and approximately as wide as the diameter of the collar statement 18. Stated otherwise, the handhold 34 is clearly illustrated in the drawing to extend about five-sixths the way around the drill pipe 10. Certainly the handhold extends over two-thirds the way around the pipe. Therefore, the clamp may be attached around the drill pipe 10 without pulling it over one end. The handhold 34 is attached to the collar segment 18 by spokes 36 which extend from the collar segment to the handhold perimeter. I find it convenient to make these spokes 36 tangent to the collar at the opening and to use a total of four spokes, two of the spokes being formed by a single strap of metal which extends from the gap to the opposite side of the ring, all as may be more definitely seen in FIGS. 2 and 3. This way the spokes 36 also aid in guiding the clamp 16 around the drill pipe 10 when attaching the same.

Flange 38 is attached to the top of the collar segment 18. This flange 38 forms a resting place for the rotating head 12. I.e., the rotating head actually rests upon the flange 38 which is attached to the collar segment 18 which is firmly secured to the pipe 10 by the latching of the gate 20. The flange is conveniently formed of a semicircular rod welded to the top of the collar segment 18. Therefore, the gate may be freely opened and closed even with the weight of the drilling head resting upon it.

In operation when the drilling pipe is being pulled from the well and after the rotating head has been disconnected from the casing, the clamp 16 is placed upon the pipe 10 below the rotating head 12. The rotating head is lifted by a cat line (not shown). The attachment of the clamp may be made either below the rig floor at the top of the casing at the time of the rotating head is lifted. Or, if the particular driller desires to, the rotating head and clamp may be lifted as a unit with the regular hoisting equipment and the cat line to the floor of the drilling rig before the clamp 16 is attached. After the clamp 16 is attached, the drill pipe 10 disconnected from the string of pipe. The drill pipe 10 with the rotating head 12 on it may be moved to one side of the drilling rig floor by the use of the handhold 34. In this regard, the handhold provides a convenient hold for two or three men to move the rotating head on the drill pipe about.

When the string is to be reinserted into the well, again, the handhold provides a convenient means for moving it and, also, after the drill pipe 10 is placed with the pin 14 above the string of pipe already in the well, the handhold 34 provides a convenient means for rotating the drill pipe 10 to start the pin into the box at the top of the string prior to the connection being tightened by conventional means.

Therefore, it may be seen that I have provided a clamp which facilitates the operations.

As an aid to correlating the terms of the claims to the exemplary drawing, the following catalog of elements is provided:

| | | | |
|---|---|---|---|
| 10 | drill pipe | 26 | keeper |
| 12 | rotating head | 28 | bolt |
| 14 | pin | 30 | set screws |
| 16 | clamp | 32 | lock nuts |
| 18 | collar segment | 34 | handhold |
| 20 | gate | 36 | spokes |
| 22 | hinge | 38 | flange |
| 24 | latch | | |

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention,

1. The method of handling a rotating head on a drill pipe at an oil well drilling site comprising the steps of:

a. firmly clamping a clamp onto the drill pipe below the rotating head, said clamp having an arcuate handhold concentric with the pipe when in place,
b. supporting the rotating head on the drill pipe by the clamp,
c. grasping the handhold to move the pipe with rotating head from one position to another, and
d. using the handhold to rotate the pipe when starting the threads of the drill pipe to a string.

2. A rotating head clamp adapted to be clamped to a drill pipe below the rotating head to hold same in place comprising:

a. a collar segment in the form of a semicircle,
b. a gate in the form of a semicircle,
c. said gate hinged to the collar segment,
d. latch means interconnecting the collar segment and gate when fastened for holding the gate securely and firmly closed and for forming the collar segment and gate into a circle, and
e. a single arcuate handhold
   i. attached to the collar segment and
   ii. concentric with the collar segment and
   iii. having an opening in its perimeter at least as wide as the collar segment diameter,
iv. the handhold extending at least two-thirds the way around the pipe,
v. the handhold extending further from the collar segment than any other element.

3. The invention as defined in claim 2 wherein f. said handhold is in the form of a rod attached to the collar segment by g. spokes from the collar segment to the rod.

4. The invention as defined in claim 2 with an additional limitation of f. a flange on top the collar segment for the rotating head to rest upon.

5. The invention as defined in claim 2 with an additional limitation of f. said hinge parallel to the axis of the collar segment.

6. The invention as defined in claim 2 with an additional limitation of f. set screws radially through the collar segment and radially through the gate so that the clamp may be adjusted for different diameter drill pipes.

7. The invention as defined in claim 6 wherein g. said handhold is in the form of a rod attached to the collar segment by h. spokes from the collar segment to the rod.

8. The invention as defined in claim 7 with an additional limitation of j. a flange on top the collar segment for the rotating head to rest upon.

9. The invention as defined in claim 8 with an additional limitation of k. said hinge parallel to the axis of the collar segment.

* * * * *